US007198209B2

(12) United States Patent
Herbst

(10) Patent No.: US 7,198,209 B2
(45) Date of Patent: Apr. 3, 2007

(54) METAL CASTING MOLDED BODY COMPRISING A CAST-IN HARD MATERIAL BODY

(75) Inventor: Horst Herbst, Königsbronn (DE)

(73) Assignee: SHW Casting Technologies GmbH, Aalen-Wasseralfingen (DE)

( * ) Notice: Subject to any disclaimer, the term of this patent is extended or adjusted under 35 U.S.C. 154(b) by 169 days.

(21) Appl. No.: 10/920,800

(22) Filed: Aug. 18, 2004

(65) Prior Publication Data

US 2005/0016708 A1 Jan. 27, 2005

Related U.S. Application Data

(63) Continuation of application No. 10/143,105, filed on May 10, 2002, now abandoned.

(30) Foreign Application Priority Data

May 11, 2001 (DE) ..... 101 22 886

(51) Int. Cl.
*B02C 7/12* (2006.01)

(52) U.S. Cl. ..... 241/30; 241/298; 241/300

(58) Field of Classification Search ..... 241/30, 241/296, 297, 298, 300, 261.2, 261.3; 428/614, 428/681, 684, 688, 539.5
See application file for complete search history.

(56) References Cited

U.S. PATENT DOCUMENTS

| | | | | |
|---|---|---|---|---|
| 4,955,135 A | | 9/1990 | Pinkhasov | |
| 5,141,683 A | * | 8/1992 | Hyndman et al. | 264/44 |
| 5,350,004 A | * | 9/1994 | Rocazella et al. | 164/97 |
| 5,664,616 A | | 9/1997 | Gegel | |
| 5,743,033 A | | 4/1998 | Gegel | |
| 5,787,960 A | | 8/1998 | Schmitt | |
| 5,880,382 A | | 3/1999 | Fang et al. | |
| 6,193,928 B1 | | 2/2001 | Rauscher et al. | |
| 6,506,270 B2 | | 1/2003 | Takashina et al. | |

FOREIGN PATENT DOCUMENTS

| | | |
|---|---|---|
| DE | 43 22 113 | 12/1994 |
| DE | 197 06 925 | 8/1998 |
| DE | 197 53 249 | 6/1999 |
| DE | 2312428 | 6/1999 |
| DE | 195 03 464 | 8/1999 |
| EP | 0 706 619 | 4/1996 |

* cited by examiner

*Primary Examiner*—Mark Rosenbaum
(74) *Attorney, Agent, or Firm*—RatnerPrestia

(57) ABSTRACT

A metal casting molded body comprising at least one effective surface for machining or processing a material and formed from a compound material, wherein said compound material comprises at least one porous hard material body in a casting matrix made of a metallic casting material, said casting material being seeped into said hard material body.

19 Claims, 2 Drawing Sheets

METAL CASTING MOLDED BODY COMPRISING A CAST-IN HARD MATERIAL BODY

BACKGROUND OF THE INVENTION

This application is a continuation of U.S. patent application Ser. No. 10/143,105, filed May 10, 2002 now abandonded.

TECHNICAL FIELD

The invention relates to a metal casting molded body comprising at least one cast-in hard material body, an application of said metal casting molded body and a method for its production.

Wear-resistant machining bodies are required for machining materials and work pieces. In particular for milling materials, for example for grinding granulate materials, machining bodies i.e. Affecting bodies are required which are wear-resistant on at least their machining surface or multiple machining surfaces.

SUMMARY OF THE INVENTION

It is thus an object of the invention to improve the wear-resistance of metal casting molded bodies, preferably of metal casting molded bodies for machining or processing materials.

In accordance with the invention, a metal casting molded body comprises at least one effective surface for machining or processing a material, said surface being formed from a compound material. When in the following only machining is mentioned, processing is always to be included. In a casting matrix made of a metallic casting material, the compound material comprises at least one porous hard material body, into which the casting material is seeped in. The at least one hard material body is, so to speak, impregnated with the casting material. The hard material body exhibits a higher wear-resistance than the casting material, such that through the compound, an effective surface with an increased wear-resistance as compared to the pure casting material is obtained. The compound material preferably possesses a closed, non-porous structure.

In preferred embodiments, a wear-resistant iron base alloy, particularly preferably wear-resistant casting iron, forms the matrix. A molybdenum-alloyed and/or chromium-alloyed casting iron, in particular highly chromium-alloyed casting iron, represents a particularly preferred matrix material. GO 300 CrNiSi 952 and GO 300 CrMoNi may be cited as examples of such a material. Another preferred matrix material is for example GO 300 NiMo3Mg or ADI (austempered ductile iron), whose structure essentially consists of bainite and/or accicular base matter. Structures with bainite and/or accicular base matter are examples of preferred structures. If the casting matrix is a bainite structure or a proportion of it has a bainite structure, then lower bainite with a forming temperature from about 250° C. and up to about 350° C. is preferred—due to its higher viscosity—to an upper bainite, which however is not to be ruled out as a structure. Beyond the particularly preferred materials for the matrix cited, any casting material known from wear-resistant casting bodies for machining material can form the matrix material. The casting material should, however, have a diamond pyramid hardness (Vickers) number of at least 400 HV.

The metal casting molded body is preferably used for milling materials and correspondingly forms a grinding body, crushing body or also a breaking body for milling granulate charging material or also larger charging materials. Such wear-resistant casting bodies are preferably used in the food industry, the coating industry, the cement industry and the brickwork industry, just to name some examples. In particular, metal casting molded bodies in accordance with the invention can be used as grinding bodies for coal and lime grinding, clinker grinding and for example the production of raw cement meal.

Although a metal casting molded body in accordance with the invention is particularly preferably a wear-resistant casting body for machining material, and here particularly preferably for milling material, the invention also relates in general to a hard material metal casting molded body, whose matrix is formed from an iron base alloy. In this case, too, the matrix material is particularly preferably a casting iron material. Thus the compound material which consists only of the casting matrix and the imbedded hard material, or is at least essentially formed from these two materials, can for example be advantageously used as a chafing body in brakes, for example in the brakes of wheeled vehicles.

The at least one hard material body is preferably a ceramic body consisting of a ceramic material from the group of carbides, oxides and nitrides or a combination of a number of these materials, or containing one of these materials or a combination of a number of these materials as a substantial component. Of the ceramic materials cited, carbides are particularly preferred, wherein this can be one or more carbides of a carbide producer or also carbides of a number of carbide producers from the group consisting of silicon, chromium, tungsten, molybdenum, vanadium, niobium, titanium, zirconium, tantalum, and hafnium, and wherein the carbide content of the ceramic body is at least 20% by weight and at most 70% by weight. Preferably, the carbide content is at least 30% by weight and at most 60% by weight. The carbide proportion is preferably formed by silicon carbide (SiC), on its own or also in combination with other carbides.

The hardness of the hard material body is preferably greater than that of the matrix material. While the diamond pyramid hardness (Vickers) number of the matrix material is not greater than about 800 HV, the hard material body possesses a diamond pyramid hardness (Vickers) number of at least 1000 HV and more preferably of at least 2000 HV. Furthermore, it also preferably possesses a greater resistance to compression than the matrix material. Ceramic hard material bodies of the type cited possess these properties and often exhibit a diamond pyramid hardness (Vickers) number of up to about 3000 HV.

In order to help the casting material seep in, and to even more preferably help the hard material body be completely permeated, the hard material body is open-pored, i.e. it exhibits an open porosity. The pore density of the hard material body should be at least 5 ppi (pores per square inch), but at most 100 ppi. The pore density is particularly preferably at least 10 ppi and at most 50 ppi. The pores preferably exhibit a diameter of at least 20 μm and at most 1000 μm. The diameter of the pores is particularly preferably at least 50 μm and at most 500 μm.

A ceramic hard material body preferably exhibits a foam structure. Such a ceramic foam body can consist of a ceramic material and can exhibit a structure such as is known from casting filters for metal molten mass, in particular from casting filters for casting iron materials. A casting filter in fact directly represents a particularly preferred hard material body. For the invention, therefore, the hard material body does not have to be especially produced first, but can advantageously be drawn, so to speak, from the rod. A preferred structure a sponge-like.

In the following Table 1, a preferred ceramic foam material is given with preferred value ranges of the material parameters, particularly preferred value ranges being entered in brackets:

TABLE 1

| foam ceramic hard material body | |
|---|---|
| Pore density | 5–100 ppi (10–50 ppi) |
| Pore diameter | 20–1000 μm (50–500 μm) |
| Surface/volume | 0.01–10 $m^2/m^3$ (0.05–1.5 $m^2/m^3$) |
| Diamond pyramid hardness (Vickers) number | 1000–3000 HV (>2000 HV) |
| Carbide proportion | 20–70% by weight (30–60% by weight) |
| Oxide proportion (oxides and oxide compounds) | 10–60% by weight (10–50% by weight) |
| Fixing agent (inorganic, apyrous) | 10–30% by weight (10–30% by weight) |

The oxide proportion given in the above table is preferably composed of ceramic oxides and dioxides. The oxide proportion is preferably between 10 and 40% by weight, particularly preferably between 10 and 30% by weight, and the dioxide proportion preferably constitutes 2 to 20% by weight. The oxide proportion is given in the table as a sum of all the oxide proportions. Aluminum oxide ($Al_2O_3$) in particular is suitable as the oxide, and silicon dioxide ($SiO_2$) in particular as the dioxide. The proportion of oxide is preferably between 10 and 40% by weight, and the proportion of dioxide is preferably between 2 and 20% by weight.

The at least one hard material body can be adapted in its shape to the effective surface of the metal casting molded body in accordance with the invention, to be so to speak tailor-made. In an equally preferred embodiment, the compound material is formed with a plurality of hard material bodies which are arranged side-by-side, preferably as tightly as possible side-by-side, on the effective surface of the metal casting molded body, and imbedded in the casting matrix. Each individual hard material body of the plurality of hard material bodies preferably exhibits the following dimensions: the largest length is at least 10 mm and at most 200 mm, the largest width is at least 10 mm and at most 100 mm, and the largest depth is at least 5 mm and at most 50 mm. The hard material bodies can exhibit the shape of simple cuboids, prisms and/or cylindrical bodies.

Lastly, it must be pointed out that a metal casting molded body in accordance with the invention can comprise one or more imbedded hard material bodies only locally, in particular in an area in which there is an increased danger of wear as compared to other areas. Moreover, the compound of the hard material body or bodies and the casting matrix can also particularly preferably improve the wear-resistance of the entire effective surface of the metal casting molded body.

A method in accordance with the invention, for producing a metal casting molded body comprising at least one wear-resistant surface, comprises at least the two following steps: at least one porous hard material body is attached to a casting mould surface in a casting mould, for example by means of one or more mould nails. The casting mould surface to which the at least one hard material body is attached preferably exhibits the shape of the wear-resistant surface of the metal casting molded body. If the at least one hard material body only forms an area of this surface, but the surface in question is to be particularly wear-resistant over a larger area, a number of such hard material bodies are arranged on and attached to the casting mould surface tightly, side-by-side. After the at least one hard material body or the number of hard material bodies has been attached, the casting mould is effused with a molten mass of an iron base material which is wear-resistant when solidified, such that the casting material imbeds the hard material body or bodies and seeps into the hard material body or bodies. The iron base material is preferably a casting iron material of the type which has already been cited as preferred. The at least one hard material body is a ceramic body made of a material known from casting filters for iron base alloys and comprising a structure known from these casting filters. It is preferably a ceramic foam body. The statements made about the hard material body or bodies with respect to metal casting mould bodies in accordance with the invention also apply to with respect to the method, particularly since the method particularly preferably relates to the production of a wear-resistant casting body, in accordance with the invention, for machining material.

The hard material body retains its structure during the casting process, i.e. it is structurally stabile at the casting temperature. In the case of preferred iron base alloys, the hard material body is structurally stabile up to at least 1400° C., preferably up to at least 1500° C. Ceramic materials exhibit a good thermal fatigue resistance, which ensures good resistance against fragments breaking off during changes in temperature during the production process on the one hand, and on the other also good resistance against changing temperatures in the operational use of the metal casting molded body. Moreover, ceramic hard material bodies can easily be wetted with conventional casting materials, such that it is possible to produce metal casting molded bodies with the desired closed, non-porous structure of the compound material. Since, in a preferred application as a grinding body, the effective or working surface of the grinding body is primarily strained by pressure and the resistance to compression of preferred hard material bodies is higher than that of the matrix material, the matrix material is protected against friction wear and other destruction by the hard material body or bodies, such that the resistance to compression of the grinding body or of a similarly strained metal casting molded body is significantly increased on the effective surface or more generally on the wear-resistant surface as a whole.

As compared to a metallurgical alloying of carbides, the compound formed in accordance with the invention comprises the advantage that the mechanical properties of the metal casting molded body are not disrupted by the usually pointed carbides, since due to the smooth-walled porous structure of the hard material body, no interior notch effect occurs in the solidified casting material, i.e. in the base structure of the material.

BRIEF DESCRIPTION OF THE DRAWINGS

The invention will now be explained by way of a preferred example embodiment. Features disclosed by way of the example embodiment, each individually and in any combination of features, advantageously develop the subjects of the claims. There is shown:

DETAILED DESCRIPTION

Figure 1:
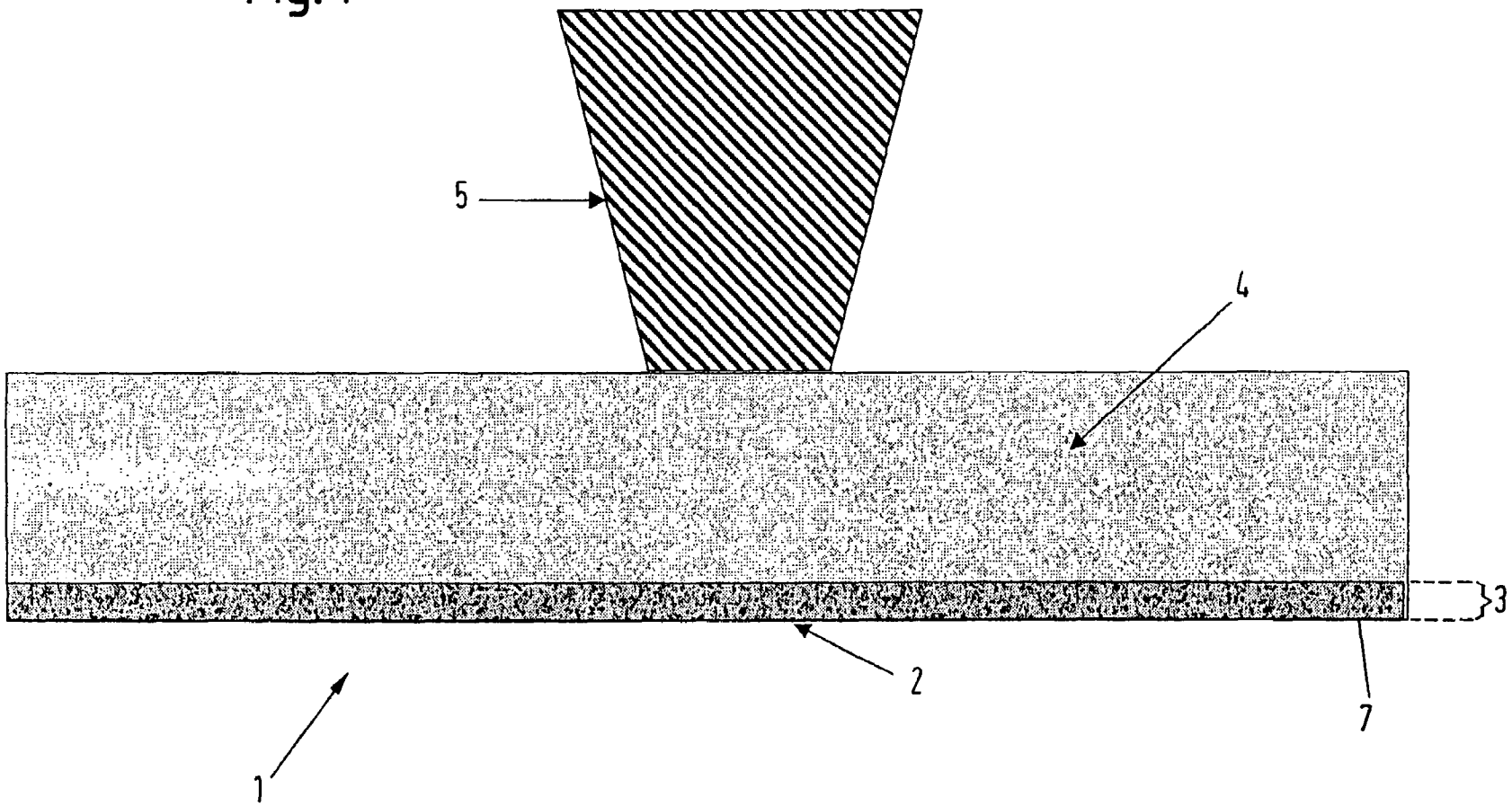
FIG. 1 a metal casting molded body comprising imbedded hard material bodies, in a cross-section.

FIG. 1 shows a cross-section of a metal casting molded body 1 which in the example embodiment is a grinding plate segment for a grinding gear for grinding granulate materials, for example coal, lime, clinker or raw cement meal. The metal casting molded body 1 can be formed as a cylinder ring segment, such as for example the metal casting test body shown in FIG. 3. Casting as a complete cylinder ring, or as any other grinding body shape, is also conceivable. The casting is static gravity casting, in a casting mould using an overhead feeder 5.

On an facing surface which forms a plane working or effective surface 2, the metal casting molded body 1 comprises a compound material in a layer 3 with a layer thickness of about 20 mm and which is uniformly thick across the entire effective surface. The compound material of this layer consists of a plurality of hard material bodies 7 (FIG. 2) arranged tightly side-by-side, which are permeated by the solidified casting material. The casting material forms a casting matrix 4 in which the hard material bodies 7 are imbedded and form the effective surface 2 when bonded with the casting material. In order to enable as complete a permeation as possible, the hard material bodies 7 exhibit an open porosity. The hard material bodies 7 consist of a foam ceramic with high temperature stability which retains its open-pored structure during the casting process, i.e. at the casting temperature of the metal molten mass.

In the example embodiment, the hard material bodies 7 are formed by a foam ceramic, such as are known from casting filters for iron base alloys, preferably casting iron. The pore density of the hard material bodies 7, measured in ppi (pores per square inch), is chosen according to the casting material. A foam ceramic which can be used as a filter for the molten mass in question naturally already exhibits a porosity which is favorable for as complete a permeation as possible, such that adapting essentially poses no problems. Since greater demands are made on the casting filter with regard to through-flow and therefore permeability because of the greater danger of occlusion in filter applications, this demand for complete permeability is easily fulfilled when using casting filter materials. Since, for producing the metal casting molded body 1, material has to flow through the hard material bodies 7, i.e. permeate them, only once, it can be assumed that all casting filters which are used for filtering iron base molten masses are also suitable as hard material for the compound material of the metal casting molded body 1. It can be assumed that the pore density of the hard material bodies 7 can even be greater for the metal casting molded body 1 than the pore densities of conventional casting filters for iron base molten masses.

The casting matrix 4 is formed for example from the material GO 300 CrNiSi 952. This and other particularly preferred materials for the casting matrix 4 of the example embodiment, and any other metal casting molded body in accordance with the invention, are quoted in the following Table 2:

TABLE 2

| | casting matrix materials | |
|---|---|---|
| Symbol | Material number (DIN 1695)/ commercial name | Structure |
| G-X 300 NiMo 3 Mg | 0.9610 | Bainite and/or martensite, spheroidal graphite, structure generally free of carbides |

TABLE 2-continued

| | casting matrix materials | |
|---|---|---|
| Symbol | Material number (DIN 1695)/ commercial name | Structure |
| G-X 260 NiCr 4 2 | 0.9620 Ni-Hard 2 | Cementite in a predominantly martensite base matter |
| G-X 330 NiCr 4 2 | 0.9625 Ni-Hard 1 | |
| G-X 300 CrNiSi 9 5 2 | 0.9630 Ni-Hard 4 | Predominantly chromium carbide in a martensite base matter, possibly with restaustenite. |
| G-S 300 CrMo 15 3 | 0.9635 Alloy 15-3 | Predominantly chromium carbide in a base matter which, according to composition and heat treatment, predominantly consists of perlite, martensite or austenite. |
| G-X 300 CrMoNi 15 2 1 | 0.9640 Alloy 15-2-1 | |
| G-X 260 CrMoNi 20 2 1 | 0.9645 Alloy 20-2-1 | |
| G-X 260 Cr 27 | 0.9650 | |
| G-X 300 CrMo 27 1 | 0.9655 | |

Figure 2:
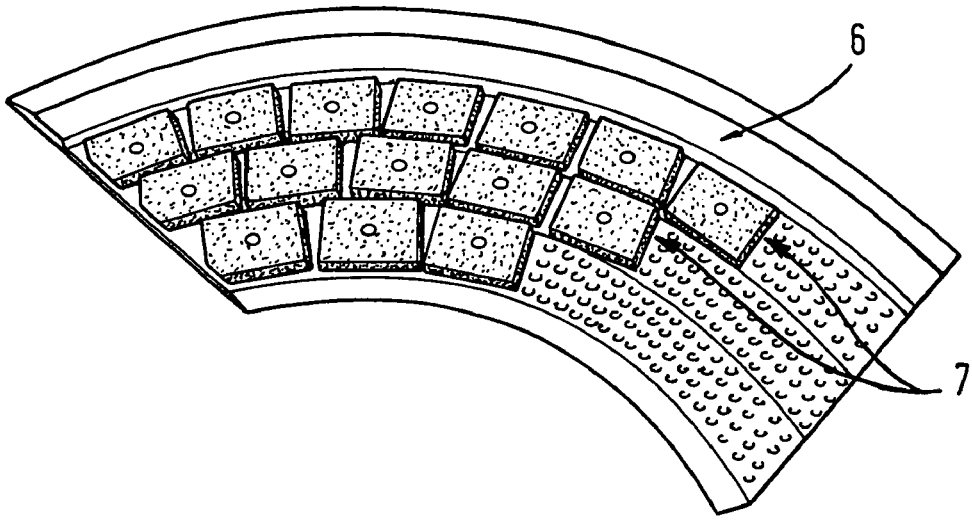
FIG. 2 a casting mould comprising hard material bodies laid out in it, for producing a metal casting test body.

FIG. 2 shows a ring segment-shaped casting mould 6 from above, on whose base area hard material bodies 7 are laid tightly side-by-side. The hard material bodies 7 are each formed by a cuboid with a length of 75 mm, a width of 50 mm and a depth of 20 mm. The hard material bodies 7 are attached to the base area of the casting mould 6 in this arrangement using mould nails. Exactly cuboid hard material bodies 7 were used for casting the test body, such as are directly obtainable as ceramic foam casting filter bodies. To completely uniformly cover the base area of the casting mould 6, and therefore form a completely uniform compound structure in the compound material layer 3 (FIG. 1), hard material bodies 7 which are more exactly adjusted to the shape of the effecting surface 2 of the metal casting molded body 1 can of course also be used. In particular, the compound material layer 3 can also be formed with a single, homogenous hard layer body.

Figure 3:
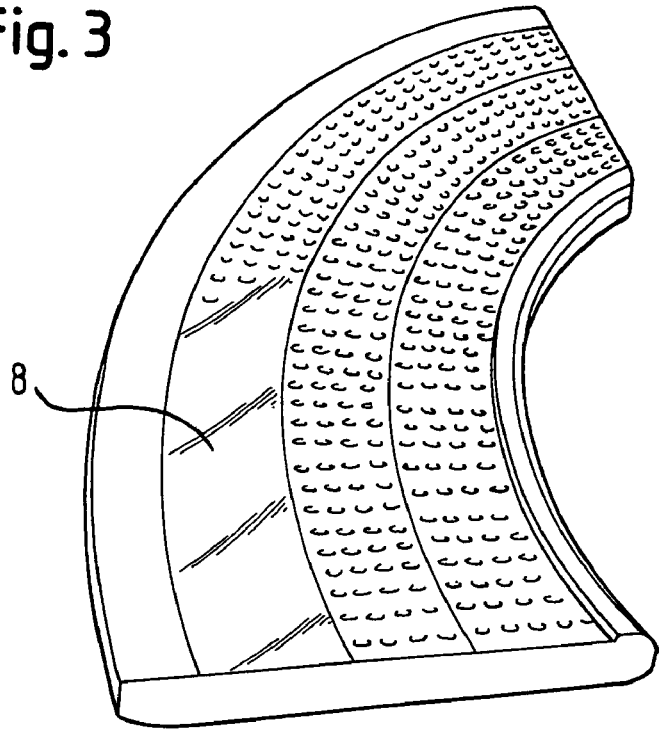
FIG. 3 the cast metal casting test body.

FIG. 3 shows the cast test body after it has been removed from the casting mould 6. The test body has been ground in the area of a ring segment surface 8. The surface of the test body formed by the compound material is extremely difficult to grind. The shavings lay mainly in the grinding wheel and not on the test casting body. As compared to a conventional production method, i.e. a metal casting molded body with just the casting matrix 4 and without the compound material layer 3, a significant increase in the wear-resistance of the casting surface could be observed, such as is advantageous for a metal casting molded body 1 for machining material.

In the foregoing description a preferred embodiment of the invention has been presented for the purpose of illustration and description. It is not intended to be exhaustive or to limit the invention to the precise form disclosed. Obvious modifications or variations are possible in light of the above teachings. The embodiment was chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed:

1. A method for grinding a granulate charging material comprising the steps of:

providing a granulate charging material;

providing a metal casting molded grinding body comprising at least one surface effective for machining or processing the granulate charging material, wherein the metal casting molded grinding body comprises a compound material of i) at least one porous hard material body, and ii) a metallic casting matrix material, and wherein the metallic casting matrix material is seeped into the at least one porous hard material body; and contacting the granulate charging material with the at least one effective surface of the metal casting molded grinding body.

2. The method of claim 1, wherein the matrix is a wear-resistant iron base alloy.

3. The method of claim 1, wherein the at least one porous hard material body is a ceramic body comprising a ceramic material selected from the group consisting of carbides, oxides, nitrides, and combinations thereof.

4. The method of claim 1, wherein the at least one hard material body is a ceramic body and contains a carbide content of at least 20% by weight and at most 70% by weight, wherein the carbide is of a carbide producer selected from the group consisting of silicon, chromium, tungsten, molybdenum, vanadium, niobium, titanium, zirconium, tantalum, and hafnium.

5. The method of claim 1, wherein the at least one porous hard material body is open-pored and exhibits a pore density of at least 5 ppi and at most 100 ppi.

6. The method of claim 1, wherein the at least one porous hard material body is a ceramic body having a foam structure.

7. The method of claim 1, wherein a plurality of the at least one porous hard material bodies are arranged side-by-side in the metallic casting matrix material to form the effective surface.

8. The method of claim 1, wherein the metallic casting matrix material is a chromium-alloyed and/or molybdenum-alloyed casting iron.

9. The method of claim 1, wherein the metallic casting matrix material exhibits at least one of a bainite or a martensite structure or a combination thereof.

10. A method for grinding a granulate charging material comprising the steps of:

providing a granulate charging material;

providing a metal casting molded grinding body comprising a surface which comprises at least one hard material body imbedded in an iron-base alloy casting matrix, wherein the iron-base alloy casting matrix is seeped into the at least one hard material body; and contacting the granulate charging material with the surface of the metal casting molded grinding body.

11. The method of claim 10, wherein the at least one hard material body is a ceramic body comprising a ceramic material selected from the group consisting of carbides, oxides, nitrides, and combinations thereof.

12. The method of claim 10, wherein the at least one hard material body is a ceramic body and contains a carbide of a carbide producer selected from the group consisting of silicon, chromium, tungsten, molybdenum, vanadium, niobium, titanium, zirconium, tantalum and hafnium, and in that the carbide content is at least 20% by weight and at most 70% by weight.

13. The method of claim 10, wherein the at least one hard material body is open-pored and exhibits a pore density of at least 5 ppi and at most 100 ppi.

14. The method of claim 10, wherein the at least one hard material body is a ceramic body having a foam structure.

15. The method of claim 10, wherein a plurality of the at least one hard material bodies are arranged side-by-side in the iron-base alloy casting matrix material to form the surface.

16. The method of claim 10, wherein the iron-base alloy casting matrix material is a chromium-alloyed and/or molybdenum-alloyed casting iron.

17. The method of claim 10, wherein the iron-base alloy matrix exhibits at least one of a bainite or a martensite structure or a combination thereof.

18. The method of claim 10, wherein the iron-base alloy casting matrix comprises a wear-resistant casting iron.

19. The method of claim 10, wherein the iron-base alloy casting matrix comprises a casting iron.

* * * * *